US005325964A

United States Patent [19]

Lyons

[11] Patent Number: 5,325,964

[45] Date of Patent: Jul. 5, 1994

[54] FIBROUS INSULATION SUPPORT PINS

[75] Inventor: John E. Lyons, Levitown, N.Y.

[73] Assignee: Duro Dyne Corporation, Farmingdale, N.Y.

[21] Appl. No.: 52,527

[22] Filed: Apr. 29, 1993

[51] Int. Cl.[5] ..... B65D 85/24

[52] U.S. Cl. ..... 206/345; 206/338; 206/343; 206/460

[58] Field of Search ..... 206/338, 340, 343, 344, 345, 206/390, 460

[56] References Cited

U.S. PATENT DOCUMENTS

| | | | |
|---|---|---|---|
| 35,902 | 7/1862 | Startevant | 206/345 |
| 3,276,576 | 10/1966 | Langas et al. | 206/344 |
| 4,279,341 | 7/1981 | Pleickhardt | 206/345 |
| 4,429,202 | 1/1984 | Hinden . | |
| 4,482,795 | 11/1984 | Hinden . | |
| 4,514,126 | 4/1985 | Knowles | 206/338 |

*Primary Examiner*—David T. Fidei

*Attorney, Agent, or Firm*—Mark T. Basseches; Paula T. Basseches

[57] ABSTRACT

An article of manufacture comprises an elongate strip or reel of separable metallic segments having pressure sensitive backing tape secured thereto. The segments include a cutout defining an elongate tine bendable to right angles to the main body portion of the segment. The tines include a longitudinally directed reenforcing rib, the side edges of the tine and the rib being formed with aligned notches enabling the fine to be bent at right angles in registry with the notches. A washer is provided which may be sleeved over the tine, the washer including an aperture configured such that when the washer is mounted over the tine and rotated, the washer will be locked to the tine.

9 Claims, 2 Drawing Sheets

FIBROUS INSULATION SUPPORT PINS

BACKGROUND OF THE INVENTION

The present invention is directed to support pins of the type employed to support fibrous insulation batts to the interior of ducting in air conduit systems, such as air conditioning and heating systems.

THE PRIOR ART

In high efficiency-low loss ducting systems for the conduction of air, it is conventional to line the interiors of the ducts with a fibrous insulation batt to minimize heat transfer through the duct. Since the insulation will be permanently encompassed within the duct, it is important that the insulation be permanently bonded to the duct interiors.

Conventional systems for mounting the insulation include adhesives interposed between the insulation and duct. It is further known to employ in conjunction with the adhesives ancillary means for retaining the insulation material. Such ancillary means may include pins having a large head or washer, the pointed end of which is passed through the insulation batt (the batt typically comprising a fibrous material such a fiberglass with a plastic or metallic skin covering one or both surfaces). The pin may be secured to the duct interior as by a resistance weld. By way of example, reference is made to U.S. Pat. Nos. 4,482,795 and 4,429,209 owned by the assignee of the instant application.

An alternate means of providing ancillary securment of the insulation involves the use of a nail-like device having a large head and a projecting shank pointed at its distal end. The rear surface of the enlarged head is provided with a pressure sensitive adhesive covered by a release layer. The device is used by stripping the release layer and forcing the exposed pressure sensitive layer against the interior of the duct and thereafter forcing the insulating batt against the duct surface, whereby the insulation will be pierced by the sharpened shank of the pin. A washer is mounted over the exposed point of the pin to lock the insulation in place.

The adhesive type pins heretofore known are subject to several disadvantageous characteristics which are cured by the pin of the instant invention. Specifically, the pins are relatively bulky when packaged, since they present three dimensional configurations. Additionally, in use the process of removing the release paper from the pin head is an awkward procedure, since an edge portion for gripping is not always readily accessible.

SUMMARY OF THE INVENTION

The present invention may be summarized as directed to an article of manufacture comprising an elongate strip or a reel formed of a spirally wound strip of pins, which may be readily separated from the strip and formed into insulation support pins.

More specifically, the invention comprises an elongate strip of metal, the rear surface of which is attached to a coextensive length of two sided pressure sensitive tape. A first face of the tape is bonded to the rear surface of the strip. The strip is formed into readily separable segments as by transverse notches and score lines. Each of the segments includes a cutout area defining a tine. In use, individual segments are separated from the strip, a procedure which automatically removes the release paper from the rear surface of the segment. The tine is thereafter readily bent at right angles to the remainder of the segment, the tine including a sharpened point. The thus formed insulation support pin may be pressed against the interior of the duct where it is retained by the pressure sensitive surface exposed by removal of the release layer.

A further characterizing feature of the device resides in the construction of the tine which includes a longitudinally directed central rib deflected from the plane of the tine. The tine includes aligned notches formed on its side edges and the rib, whereby the tine may be bent at right angles (i.e. to a position parallel with the head of the pin) at locations in registry with the aligned notches.

In accordance with a further embodiment of the invention there is provided a locking washer mountable over the tine of the pin (in lieu of or in addition to bending of the tine). The locking washer includes a transverse slot, the extent of which is greater than the width of the tine whereby the washer may be slipped over the tine. The washer includes a central aperture, the diameter of which is less than the distance between the bases of the notches on the pin tine. The washer may be permanently mounted over the tine by forcing the washer over the tine with the slot aligned with the plane of the tine, passing the washer along the length of the tine to partially compress the insulation between the washer and head of the pin until the washer is aligned with notches formed in the tine. At this position the washer may be rotated 90 degrees whereby portions of the washer surrounding the aperture will enter into the notches of the tine locking the washer in position.

It is accordingly an object of the invention to provide an article of manufacture comprised of an elongate strip or a roll of insulation mounting pins which is compact, and from which individual pins may be readily separated and bent into a configuration for use in supporting the insulation.

A further object of the invention is the provision of an article of the type described wherein removal of the release layer is an inherent result removal of individual pins from the reel.

A further objection of the invention is the provision of an improved insulation support pin which may selectively be used as an insulation holding device either by bending the tine (after initial bending and mounting) to insulation supporting position, or by mounting a washer on the tine.

DETAILED DESCRIPTION OF DRAWINGS

Figure 1:
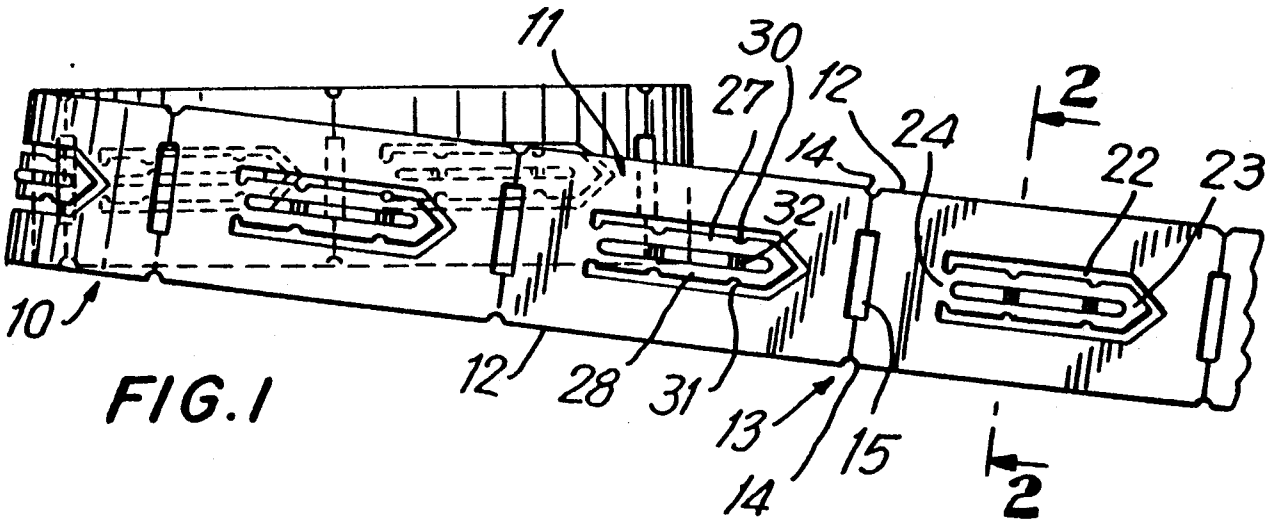
FIG. 1 is a top plan view of a reel of insulation support pins in accordance with the invention.

Referring now to FIG. 1, there is shown a reel 10 comprising a spirally wound band of metal 11, the band being divided into readily separable segments 12 along weakened lines 13 defined by notches 14 and a central blanked-out area 15. Obviously, alternate means for enabling separation of individual segments may be provided and the articles may be packaged as elongate strips rather than as a reel.

Figure 2:
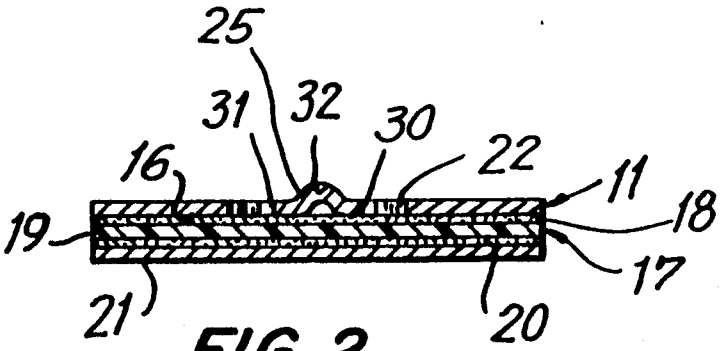
FIG. 2 is a section taken on the line 2—2 of FIG. 1 on an enlarged scale.

As best seen in FIG. 2 the band 11 is provided on its rear surface 16 with a pressure sensitive double sided tape assembly 17 comprising an upper adhesive layer 18 bonded to the surface 16, a carrier portion 19, a rear pressure sensitive layer 20 and a release layer 21.

As will be understood from the above description, when each segment is separated from the band, the tape components, which are also scored in registry with the separation areas between segments, will enable the tape segments to be separated with the metal segments. The act of separating individual segments results in a partial lifting of the lightly adhered release layer enabling portions of the release layer to be readily grasped, whereby removal of the release layer is facilitated.

The individual segments include a blanked-out area 22 defining an elongate tine 23. The tine 23 is connected to the main body of the segment at hinge area 24, whereby the tine may be readily bent at right angles to the remainder of the segment (see FIGS. 5 and 6).

Figure 3:
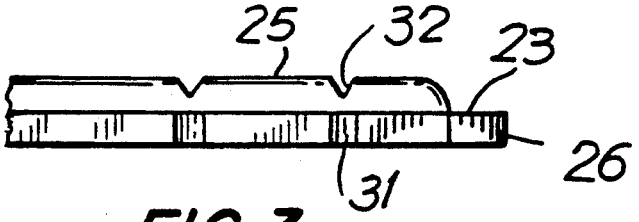
FIG. 3 is a fragmentary enlarged side elevational view of a portion of a tine of the pin of the invention.

As best seen from the enlarged view FIG. 3, the tine includes a central embossed rib 25 extending essentially from the hinge area 24 to a position adjacent the sharpened tip 26. The side edges 27,28 of the tine are provided with notches 30,31 respectively, which notches are aligned with notches 32 formed in the rib 25.

As will be appreciated the above description, the rib 25 provides a substantial stiffening of the tine rendering it resistant to transverse bending except at the aligned notches 30,31,32 which provide areas where the tine may be readily bent.

As is apparent from FIG. 3, a series of sequences of notches 30,31,32 may be provided along the length of the tine to enable the tine to be bent at any of a selected series of distances from the plane of the blank in accordance with the thickness of the insulation.

Figure 4:
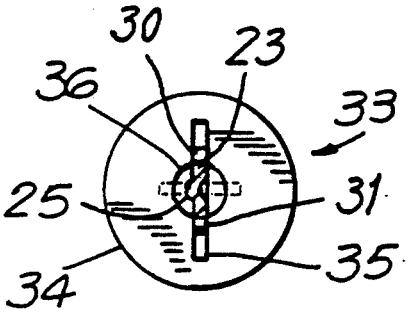
FIG. 4 is a plan view of a washer applied to the tine.

In FIG. 4 there is shown a washer 33 particularly adapted to be used in conjunction with the pin previously described in locked position over the tine of the pin. The washer comprises a circular plate 34 having a transversely directed slot 35 and a central blanked-out circular area 36. The longitudinal extent of the slot 35 is greater than the transverse dimension of the tine whereby, as shown, the washer may be slipped over the tine. The diameter of the blanked-out area 36 is smaller than the distance between the bases of notches 30 and 31.

As will be apparent from the succeeding description, this construction enables the washer to be sleeved over the tine, and rotated when in alignment with one of the sets of notches 30,31. When thus rotated, i.e. to 90 degrees, the circular area 36 will enter into the notches 30,31,32 thereby preventing the washer from being lifted upwardly off of the tine.

Figure 5:
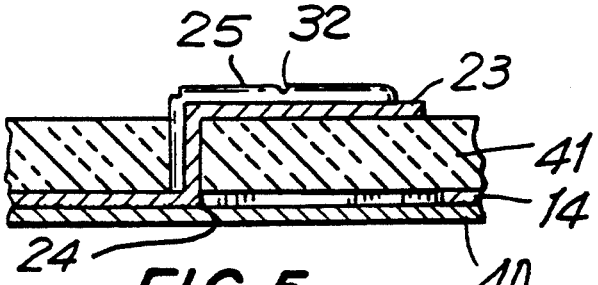
FIG. 5 is a fragmentary sectional view of the pin mounted to the interior of the duct showing the manner in which insulation is secured to the duct by bending of the tine.

Referring now to FIG. 5, there is shown one mode of utilizing the pin. More particularly, the head or segment 14 is shown as bonded to an interior surface of duct 40 with the tine having penetrated insulation 41, the tine having been bent over as shown to capture the insulation.

Figure 6:
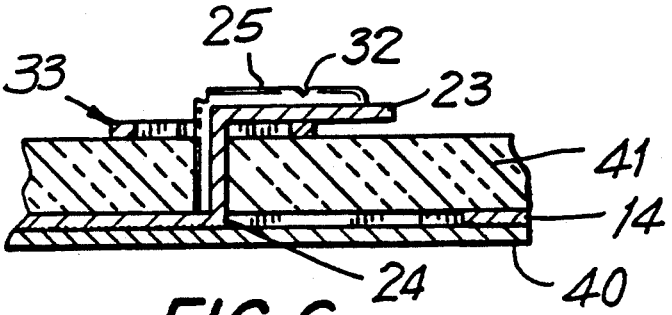
FIG. 6 is a view similar to FIG. 5 showing an alternate manner in which the washer may be employed as an adjunct to securing the insulation material.

In FIG. 6, washer 33 has been emplaced over the tine and locked in position by turning, following which the tine has been bent to a position parallel to the duct 40, firmly to lock the washer in position.

From the foregoing, it will be readily appreciated that there is disclosed in accordance with the invention an improved article of manufacture, namely an elongate strip of metal which may be supplied as such or coiled to form a reel, from which individual insulation support pins may be readily removed and bent to define insulation support pins. The unique structure of the support pins, and particularly the shank or tine portions thereof provide a stiffened member, which may nonetheless be readily bent to capture the insulation at any of a selected series of positions along the length thereof in registry with the notches formed on the tines.

There is further disclosed a novel pin and washer configuration whereby washers may be locked to the tines by sleeving the washers over the tine and rotating same to locked position.

As will be apparent to those skilled in the art and familiarized with the instant disclosure numerous changes in details of construction may be effected without departing from the spirit of the invention which is accordingly to be broadly construed within the scope of the appended claims.

I claim:

1. An article of manufacture, a strip of separable insulation support pins comprising a metal band having a rear surface, an elongate, double faced adhesive tape member coextensive with said band, said tape member including a first face adhesively bonded to said rear surface, and a release layer covering the adhesive surface of said tape remote from said band, said band being divided into segments separated by frangible transverse score lines, said segments each including a cutout area defining an elongate tine having a point at one end and a flexible line at the other end hingedly joining said tine to said segment.

2. An article in accordance with claim 1 wherein said tine includes a longitudinally extending embossed stiffener rib disposed between said ends, said rib being deflected from the plane of said tine.

3. An article in accordance with claim 2 wherein said ribs are located in a plane opposite said rear surface of said band.

4. An article in accordance with claim 3 wherein said tines include generally parallel side edges, and longitudinally aligned notch means formed in said rib and side edges.

5. A support pin in accordance with claim 8 and including a washer having a transversely directed slot formed therethrough, said slot being sized to receive said tine.

6. A support pin in accordance with claim 5 wherein said notch means includes base portions inwardly spaced from said side edges and said washer includes a central aperture intersecting said slot, the diameter of said aperture being less than the length of said slot and greater than the distance between said base portions of said notches.

7. A reel of separable insulation support pins comprising an elongate metal band having a rear surface, an elongate double faced adhesive tape member coextensive with said band, said tape member including a first face adhesively bonded to said rear surface, a body portion, a pressure sensitive adhesive layer covering said body portion, and a release sheet covering said pressure sensitive layer, said band being divided into segments separated by frangible transverse score lines, said segments including a body portion, a cutout area formed through said body portion defining an elongate tine having side edges, a flexible link joining one end of said tine to said body portion, and a point formed at the other end of said tine, a longitudinally directed embossed stiffener rib formed in said tine, said rib being deflected from the plane of said tine, and notch means formed in said rib and said side edges, said notch means being spaced at aligned positions along the length of said tine.

8. A support pin comprising a planar sheet metal blank having a rear surface, a double faced adhesive tape member coextensive with said blank, said tape member including a first face adhesively bonded to said rear surface, a body portion, a pressure sensitive layer covering said body portion, and a release sheet covering said pressure sensitive layer, said blank including a cut-out area formed through said blank and tape member and defining an elongate tine having generally parallel side edges, a flexible link joining one end of said tine to said body portion, said link being generally perpendicular to said side edges, and a point formed at the other end of said tine, a longitudinally directed embossed stiffener rib formed in said tine, said rib being deflected from the plane of said blank, and notch means formed in said rib perpendicular to said side edges for facilitating bending of said tine in registry with said notch means.

9. A support pin in accordance with claim 8 wherein a plurality of mutually spaced said notch means are formed in said rib.

* * * * *